United States Patent [19]

Williams

[11] Patent Number: 4,982,865

[45] Date of Patent: Jan. 8, 1991

[54] WALL COUPLING WITH FLEXIBLE RETAINING STRIP

[75] Inventor: David A. Williams, Hartford, Great Britain

[73] Assignee: Lin Pac Mouldings Limited, Birmingham, United Kingdom

[21] Appl. No.: 403,611

[22] Filed: Sep. 6, 1989

[51] Int. Cl.[5] ..... B65D 45/20

[52] U.S. Cl. ..... 220/324; 229/125.21; 24/297

[58] Field of Search ..... 24/297, 453; 229/125.21; 220/315, 324

[56] References Cited

U.S. PATENT DOCUMENTS

| | | | |
|---|---|---|---|
| 1,908,667 | 5/1933 | Greve | 229/125.21 |
| 2,388,288 | 11/1945 | Ringler | 229/125.21 |
| 2,853,224 | 9/1958 | Slater | 229/125.21 |
| 3,767,110 | 10/1973 | Congleton | 220/324 |
| 3,875,843 | 4/1975 | Maeda | 229/125.21 |
| 4,312,614 | 1/1982 | Palmer | 24/297 |
| 4,438,552 | 3/1984 | Omata | 24/297 |
| 4,462,142 | 7/1984 | Hickling | 220/324 |
| 4,517,711 | 5/1985 | Tanaka | 24/453 |
| 4,582,219 | 4/1986 | Mortensen | 220/324 |
| 4,745,666 | 5/1988 | Murphy | 24/453 |

FOREIGN PATENT DOCUMENTS

| | | | |
|---|---|---|---|
| 566840 | 12/1958 | Canada | 24/297 |

*Primary Examiner*—Stephen Marcus
*Assistant Examiner*—S. Castellano

[57] ABSTRACT

A wall coupling restrains adjacent walls 2 and 3 from displacement over each other. The two walls have coincident apertures 12 and 16. A flexible moulded plastics retaining strip 5 is carried by the wall 2 on its side remote from the wall 3. The strip 5 overlies the aperture 12 and has an end 8 which is secured relative to the wall 2 and an end 7 which is slidable along tracks on the wall 2 in a direction towards and from the end 8. A mid-length region 6 of the strip 5 between its ends 7 and 8 has integral hinges 13 to 15 so that during displacement of the strip end 7 towards the end 8, the region 6 doubles to project through the apertures 12 and 16 and thereby couple the walls 2 and 3 to restrain them from relative displacement. A combination stop/catch can be provided to temporarily retain the strip end 7 in a position where the mid-length region 6 of the strip is in either a folded or an unfolded condition.

19 Claims, 3 Drawing Sheets

WALL COUPLING WITH FLEXIBLE RETAINING STRIP

TECHNICAL FIELD & BACKGROUND ART

The present invention relates to a wall coupling and is particularly concerned with such a coupling which restrains two adjacent wall parts in overlying relationship from relative displacement over each other. Typically one wall part may be on a container lid while the other wall part is on the container body so that the coupling provides a means for retaining the lid in its closed condition. Alternatively one wall part may be coupled merely to form an extension of a component (such as a lid) having the other wall part. Numerous devices have been proposed for coupling together wall parts as aforementioned such as latches, strapping, removable pegs and snap engaging lock devices. It is often considered that known devices are relatively expensive to manufacture and/or assemble, are inconvenient to operate (either or both for coupling or uncoupling of the wall parts), that they form a relatively obtrusive part or projection on the wall parts (either when those parts are uncoupled or coupled together) or that they have a means of coupling that may be mislaid. It is an object of the present invention to provide a wall coupling which is relatively simple and inexpensive to manufacture and assemble, is easy and convenient to operate, that may form a relatively unobtrusive feature of a wall part, and which is unlikely to be accidentally damaged or mislaid.

STATEMENT OF INVENTION & ADVANTAGES

According to the present invention there is provided a wall coupling comprising a first wall part having a first opening and which is to be positioned adjacent to a second wall part having a second opening with the first and second openings coinciding; a retaining strip carried by the first wall part on the side thereof which is, or is to be, remote from the second wall part, said retaining strip overlying the first opening and having opposite end regions mounted to be displaceable relatively towards and away from each other and a mid-length region which is foldable and unfoldable respectively in response to said relative displacement of the end regions whereby, during displacement of the end regions relatively towards each other on the first wall part, the mid-length region is folded to, or towards, a doubled condition in which it extends through the first opening for entering the second opening to couple the two wall parts and to restrain them from displacement over each other.

Further according to the present invention there is provided an assembly of a component having a wall coupling as specified in the immediately preceding paragraph and a further component having a second wall part which is, or is intended to be, coupled to the first wall part by the retaining strip.

By the present invention it is contemplated that the retaining strip will be carried by the first wall part so that its end regions are displaceable towards each other in a sense whereby the mid-length region of the strip is folded to project through the opening in the first wall part and into a coincident opening of the second wall part which is positioned adjacent and conveniently (but not essentially) in face-to-face contact with the first wall part. Desirably the folded strip is a relatively close fit in both the first and second openings to alleviate relative displacement between the two wall parts.

By way of example, the first wall part may be on a closure member such as a lid or similar component which is to be coupled to a second wall part of a container body (or of an extension to the closure member). With this in mind the second wall part will have the second opening appropriately located to coincide with the first opening and to receive the folded retaining strip when the coupling is effected. The first opening will usually be in the form of a slotted aperture in the first wall part. The second opening may also be in the form of an aperture which extends through the second wall part or may be in the form of a recess in the second wall part within which recess the folded retaining strip is received Where the second opening is an aperture in the second wall part it is possible for the folded retaining strip to extend through both the first and second openings to be received in a coinciding third opening in a third wall part which third wall part is fixed relative to (conveniently being integral with) the first wall part. By this latter proposal the second wall part may be received between the first and third wall parts and coupled thereto by the folded retaining strip. With such an arrangement the folded retaining strip is not cantilevered in its coupling between the second wall part and the third wall part and thereby the retaining strip is relieved of shear forces to which it may be subjected from its coupling to the second wall part.

Preferably the relative displacement between the end regions of the retaining strip is in a plane which is parallel and adjacent to the first wall part. The aforementioned displacement may be along track means on the first wall part. The track means conveniently retains the retaining strip on the first wall part substantially unobtrusively when the retaining strip is in its unfolded condition and substantially unobtrusively on the side of the first wall part from which the folded retaining strip enters the first opening. It is not necessary for both end regions of the retaining strip to be displaceable on the first wall part. Usually one end region will be secured relative to the first wall part while the other end region is slidably displaceable (conveniently along the track means as aforementioned) relative to the first wall part to effect the folding and unfolding of the mid-length region of the retaining strip. For convenience of displacing an end region of the retaining strip, such end region may have a handle or a finger/thumb recess, ridge or the like which is intended to facilitate its manual engagement.

To alleviate inadvertent unfolding of the retaining strip it is preferred that a first stop/catch means is provided for temporarily retaining the strip in its folded condition. A second stop/catch means may also be provided for temporarily retaining the strip in its unfolded condition (for example to alleviate the mid-length region of the retaining strip from inadvertently passing through the first opening where it could possibly interfere with the location of the second wall part adjacent to the first wall part). The first and second stop/catch means conveniently comprises cooperating recesses or dimples and complementary projections which inter-engage between the strip and first wall part to provide interference which temporarily restrains the strip from sliding displacement along the aforementioned track means.

The retaining strip may be provided with one or more hinge regions which facilitate the folding and unfolding of the strip and may determine the locations on the strip at which folding is to be effected. Generally three such locations will be provided, one location being within the mid-length region of the strip and the other two locations being one at each end of the mid-length region between that mid-length region and the adjacent end region of the strip. The hinge regions may serve to determine the direction in which the mid-length region is displaced when the end regions of the strip are moved relatively towards each other (to ensure that as the mid-length region is folded to, or towards the doubled condition, a folded portion of the strip will pass through the first opening). Conveniently the hinge regions are formed integral with the retaining strip, for example by relatively thin walled sections of the retaining strip.

The retaining strip will usually be formed as a one piece plastics moulding. It is contemplated that the first wall part and the component of which it forms part will also be formed as a plastics moulding to which the retaining strip is fitted. Although the second wall part and such component of which that wall part forms part may also be of plastics, it is contemplated that this wall part is likely to be of any material such as cardboard or metal sheet.

It will be appreciated that a component may have several wall couplings in accordance with the present invention for coupling that component to one or more second wall parts.

DRAWINGS

One embodiment of a component having a wall coupling constructed in accordance with the present invention and an assembly of such component with a second wall part will now be described, by way of example only, with reference to the accompanying illustrative drawings in which.

DETAILED DESCRIPTION OF DRAWINGS

For convenience, the present example will be considered for coupling a closure member in the form of a plastics moulded lid 1 having a peripheral skirt 2 to a container body (or to an extension skirt for the lid) provided by a wall 3 which is received within a boundary presented by the skirt 2 and substantially in face-to-face contact therewith. The wall 3 will often be of plastics although it will be appreciated that other materials will be suitable for that wall.

Figure 1:
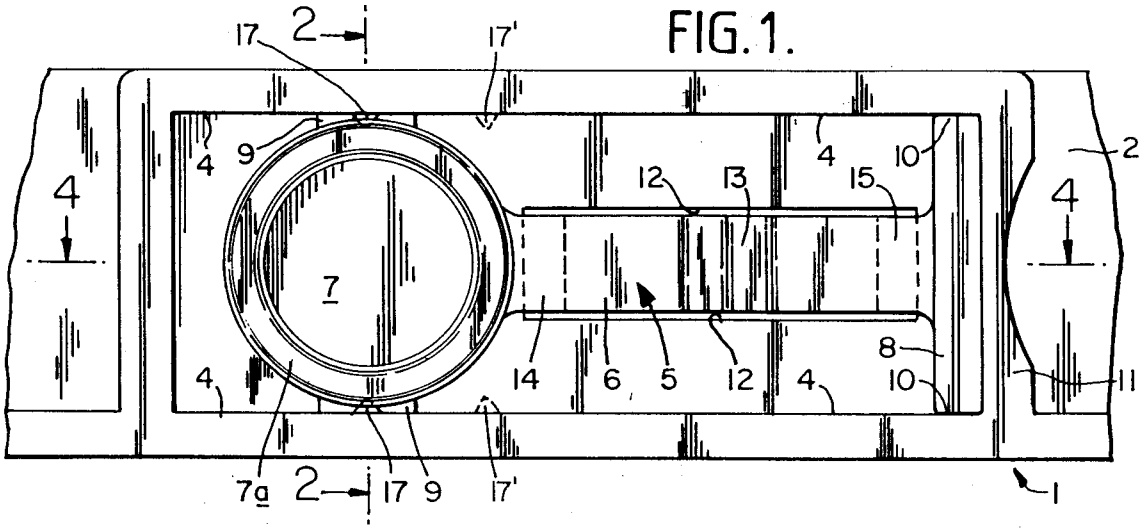
FIG. 1 is a side elevation of a wall part of the component and shows the retaining strip.
Figure 2:
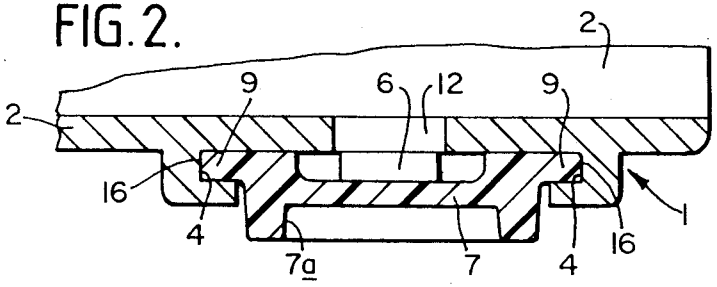
FIG. 2 is a section on the line 2-2 of FIG. 1.
Figure 3:
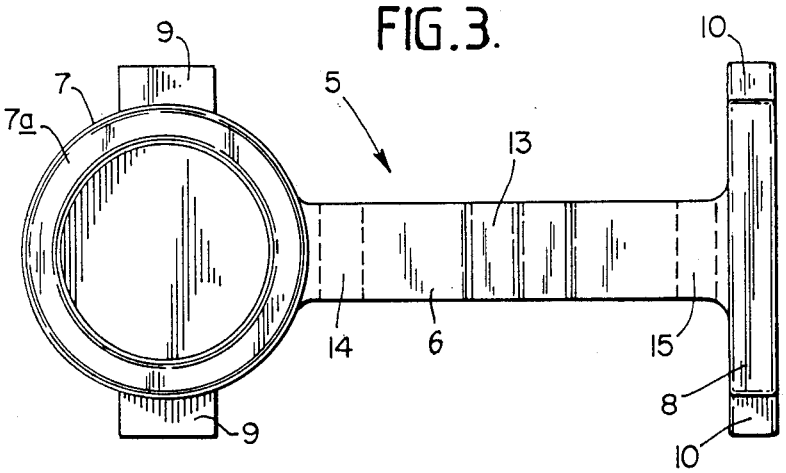
FIG. 3 shows the retaining strip incorporated in the wall coupling.

Integrally moulded with the exterior of the skirt 2 are external ribs within which are formed opposed parallel tracks 4 (see FIGS. 1 and 2). A retaining strip 5 is captured between the tracks 4. The strip 5 comprises a longitudinally extending mid-length region 6 and opposed end regions 7 and 8. The retaining strip 5 is formed as a one piece injection moulding in plastics. Conveniently the end region 7 is of circular profile with the longitudinal extent of the strip region 6 extending radially therefrom. The end region 8 is in the form of a bar extending perpendicularly relative to the longitudinal extent of the strip region 6. The circular end region 7 has diametrically opposed external flanges 9 while the opposite ends of the bar region 8 are profiled as flanges 10. The tracks 4 are in the form of longitudinally extending recesses and the flanges 9 and 10 are received within the opposed recesses 4 (as shown in FIG. 2) to retain the strip 5 on the skirt wall part 2. The tracks 4 are parallel with the longitudinal extent of the strip midlength region 6 and the end region bar 8 abuts an external rib 11 at an end of the tracks 4. The flanges 9 are received in the recesses 4 to be slidable along the tracks. The end bar 8 is welded, adhesively secured or otherwise bonded to firmly retain it adjacent to the rib 11. Alternatively the end bar 8 may be mechanically retained, for example by snap engagement or an interference fit, in the position shown in FIG. 1 adjacent to the rib 11.

Formed through the wall thickness of the skirt 2 is an elongated or slotted aperture 12 the longitudinal extent of which is parallel with that of the mid-length region 6 of the retaining strip. The strip 5 generally overlies the slotted aperture 12 as shown in FIG. 1.

The plastics retaining strip 5 is moulded with relatively thin wall portions which provide three integral and longitudinally spaced hinge regions 13, 14 and 15. Hinge region 13 is located generally at the centre length position of the mid-length region 6, the hinge region 14 is located between the end region 7 and the centre length region 6 and the hinge region 15 is located between the end region 8 and the mid-length region 6. The circular end region 7 is displaceable longitudinally towards and from the end region 8 by sliding movement of the flanges 9 along the tracks 4 and in a plane which is adjacent to and substantially parallel with the skirt wall 2. Conveniently the circular region 7 is provided with a concentric annular flange 7*a* to facilitate engagement of that region with thumb or finger for its manual displacement along the tracks 4. The plastics of the retaining strip 6 is flexible so that, in response to displacement of the end region 7 in a direction towards the end region 8, the strip folds at the hinge regions 13, 14, 15 from what may be regarded as an unfolded condition (shown in FIG. 4) to a folded condition shown in FIG. 5 where the mid-length region 6 is doubled and projects through the slotted aperture 12 of the wall 2. It will be noted from FIGS. 4 and 5 that the reduced wall thickness which forms the hinge regions 13, 14, 15 of the plastics retaining strip is offset towards one or the opposite broad faces of the mid-length region 6 as appropriate to ensure that the displacement exhibited by the retaining strip in moving from its unfolded to its folded condition is in the required direction for the doubled mid-length region to project through the slotted aperture 12. It will also be noted that in its folded condition the mid-length region 6 of the retaining strip is received closely between the opposed side edges of the slotted aperture 12 so that those side edges can restrain the folded mid-length region of the retaining strip from substantial lateral displacement.

Figure 6:
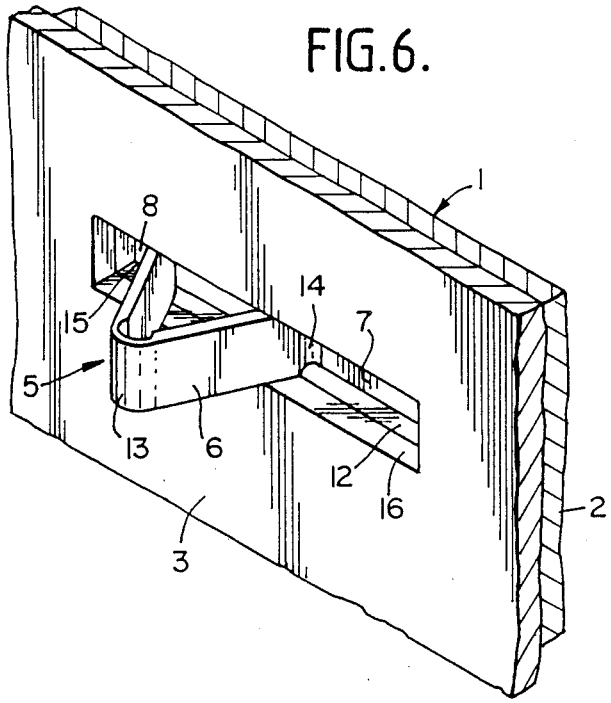
FIG. 6 is a perspective view of the coupling shown in FIG. 5.

The wall 3 is provided with an elongated aperture or slot 16 which is arranged to coincide with the slotted aperture 12 when the walls 2 and 3 are in the position at which they are required to be coupled (for example with the lid 1 correctly fitted to close the container body). In this latter position it will be apparent that the folding of the mid-length region 6 of the retaining strip from the condition shown in FIG. 4 to that shown in FIGS. 5 and 6 will cause the retaining strip to project through both slotted apertures 12 and 16. Similarly to the slotted aperture 12, the folded region 6 is closely received between the laterally opposed side edges of the slotted aperture 16 so that the wall 2 is restrained from displacement relative to the wall 3 in a direction which extends perpendicularly to the plane of the drawing in FIG. 5. It will, of course, be appreciated that relative displacement between the walls 2 and 3 in the plane of the drawing in FIG. 5 may be restrained by appropriately reducing the longitudinal extent of the slotted apertures 12 and 16 (so that in its doubled condition the mid-length region 6 of the retaining strip is received as a relatively close fit within the two apertures both in the plane of the drawing in FIG. 5 and in the plane perpendicular thereto).

Figure 4:
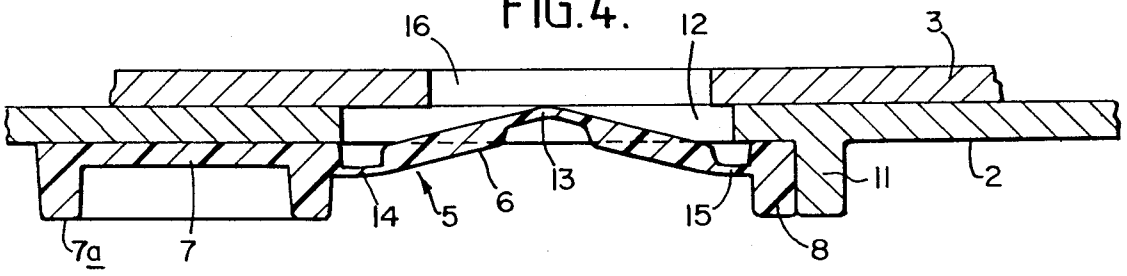
FIG. 4 is a section on the line 4-4 of the wall coupling in FIG. 1 with the wall part positioned adjacent to the second wall part for coupling thereto.
Figure 5:
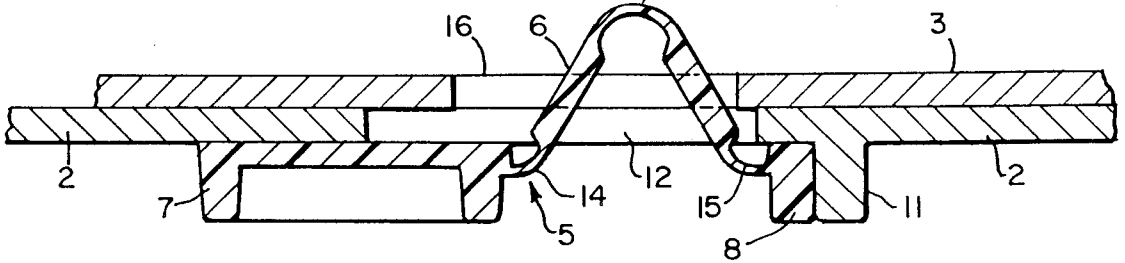
FIG. 5 is a similar section to that shown in FIG. 4 and illustrates an assembly of the two wall parts coupled together by the retaining strip.

It is likely that the plastics of the retaining strip will have a resilient nature or memory with a tendency for the strip to revert from its folded condition of FIG. 5 to its relatively unfolded condition of FIG. 4. To alleviate this and also to alleviate the likelihood of the retaining strip being inadvertently displaced from its folded to its unfolded condition, it is preferred that a combination stop/catch 17' is provided on each of the tracks 4 with which the flanges 9 can engage when the end region 7 is displaced to fold/double the mid-length region 6. The stop/catch 17' conveniently comprise studs or recesses on the track which snap engage or otherwise interfere or catch with complementary recesses or studs respectively on the flanges 9. Similar stop/catches 17, 17 can be provided on the tracks 4 with which the flanges 9 can engage when the mid-length region of the strip is in its unfolded condition shown in FIG. 4; this is to alleviate the likelihood of the retaining strip 6 projecting through the slotted aperture 12 prior to the wall 3 being positioned adjacent to the skirt wall 2 and thereby the retaining strip from interfering with the positioning of the wall 3. The flanges 9 will, of course, be readily disengageable from either the stop/catches 17', 17' or the stop/catches 17, 17 by manual pressure applied to displace the end region 7 along the tracks 4.

Figure 7:
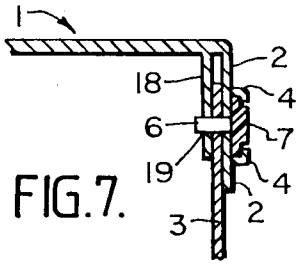
FIG. 7 shows, in part section, a modification to the wall coupling.

In the modification shown in FIG. 7 the lid 1 is provided with an internal flange 18 which extends substantially parallel to and spaced from the skirt wall 2. The flange 18 has an elongated aperture 19 which coincides with the slotted aperture 12 in the wall 2 and may be similarly sized. The wall 3 is positioned between the wall 2 and flange 18 so that its slotted aperture 16 coincides with the apertures slotted 12 and 19. When the end region 7 is displaced towards the end region 8 for the mid-length region 6 of the retaining strip to be folded, the doubled retaining strip projects through the three slotted apertures 12, 16 and 19 and may be closely received therein. Consequently the wall 3 is captured between the walls 2 and 18 to which it is coupled by the retaining strip while such shear forces to which the retaining strip may be subjected from the wall 3 are supported by both the flange 18 and wall 2 (unlike the cantilevered support for the doubled retaining strip shown in FIG. 6).

I claim:

1. A wall coupling comprising a first wall part having a first opening and which is to be positioned adjacent to a second wall part having a second opening with the first and second openings coinciding; a retaining strip carried by the first wall part on the side thereof which is, or is to be, remote from the second wall part, said retaining strip overlying the first opening and having opposite end regions mounted to be displaceable relatively towards and away from each other and a mid-length region which is foldable and unfoldable respectively in response to said relative displacement between the end regions whereby, during displacement of the end regions relatively towards each other on the first wall part, the mid-length region is folded to, or towards, a doubled condition in which it extends through the first opening for entering the second opening to couple the two wall parts and restrain them from displacement over each other wherein at least one end region of said retaining strip is displaceable along track means on the first wall part.

2. A coupling as claimed in claim 1 in which one end region of the retaining strip is secured relative to the first wall part.

3. A coupling as claimed in claim 1 in which said relative displacement between the end regions of the retaining strip is in a plane substantially parallel with and adjacent to the first wall part.

4. A coupling as claimed in claim 1 and comprising stop catch means for temporarily retaining the retaining strip in its folded condition.

5. A coupling as claimed in claim 1 and comprising second stop/catch means for temporarily retaining the retaining strip in its unfolded condition.

6. A coupling as claimed in claim 1 in which said track means comprises longitudinally extending recess means on said first wall part and said at least one end region of said retaining strip is provided with flange means which engages said recess means for said at least one end region of said retaining strip to be displaceable longitudinally along said recess means.

7. A wall coupling comprising a first wall part having a first opening and which is to be positioned adjacent to a second wall part having a second opening with the first and second openings coinciding; a retaining strip carried by the first wall part on the side thereof which is, or is to be, remote from the second wall part, said retaining strip overlying the first opening and having opposite end regions mounted to be displaceable relatively towards and away from each other and a mid-length region which is foldable and unfoldable respectively in response to said relative displacement between the end regions whereby, during displacement of the end regions relatively towards each other on the first wall part, the mid-length region is folded to, or towards, a doubled condition in which it extends through the first opening for entering the second opening to couple the two wall parts and restrain them from displacement over each other, first stop/catch means and second stop/catch means located in a spaced apart relation with said first stop/catch means, each of said first and second stop catch means for temporarily retraining displacement of said retaining strip, each of said first and second stop/catch means comprising a recess and a projection which cooperate and provide interference which restrains relative displacement between said retaining strip and the first wall part.

8. A coupling as claimed in claim 1 in which said retaining strip comprises at least one hinge region which facilitates the folding and unfolding of said retaining strip and determines at least one location on said retaining strip at which folding is to be effected.

9. A coupling as claimed in claim 1 in which said retaining strip comprises at least one hinge region which determines the direction in which the mid-length region of said retaining strip is displaced when the end regions of said retaining strip are moved relatively towards each other.

10. A wall coupling comprising a first wall part having a first opening and which is to be positioned adjacent to a second wall part having a second opening with the first and second openings coinciding; a retaining strip carried by the first wall part on the side thereof which is, or is to be, remote from the second wall part, said retaining strip overlying the first opening and having opposite end regions mounted to be displaceable relatively towards and away from each other and a mid-length region which is foldable and unfoldable respectively in response to said relative displacement between the end regions whereby, during displacement of the end regions relatively towards each other on the first wall part, the mid-length region is folded to, or towards, a doubled condition in which it extends through the first opening for entering the second opening to couple the two wall parts and restrain them from displacement over each other, said retaining strip having three hinge regions, one hinge region being located within said mid-length region of said retaining strip and the other two hinge regions being located one at each end of said mid-length region of said retaining strip between that mid-length region and the adjacent end region of said retaining strip.

11. A coupling as claimed in claim 1 in which said retaining strip comprises at least one hinge region which is formed integral therewith.

12. A coupling as claimed in claim 11 in which the hinge region is formed by a relatively thin walled section of said retaining strip.

13. A coupling as claimed in claim 1 in which said retaining strip is formed as a one piece plastics moulding.

14. A coupling as claimed in claim 1 and comprising a third wall part which is secured relative to the first wall part and is spaced therefrom, the third wall part having a third opening which coincides with the first opening in the first wall part, said first and third wall parts being arranged so that the second wall part can be received between the first and third wall parts and coupled thereto by said retaining strip when in its folded condition, said folded retaining strip extending through both the first and second openings to be received within the third opening.

15. A coupling as claimed in claim 1 in which said track means comprises two opposed and substantially parallel longitudinally extending tracks between which said retaining strip is disposed so that in its unfolded condition said retaining strip overlies the first opening and wherein each of said tracks is engaged by respective flange portions of said at least one end region of said retaining strip so that said flange portions are displaceable longitudinally along said track means with which said flange portions respectively engage.

16. A coupling as claimed in claim 15 in which said first component comprises a closure member and the first wall part is provided by a skirt of the closure member and said second component comprises a body having a wall to which said closure member is fitted and coupled by said retaining strip.

17. A coupling as claimed in claim 16 further comprising said closure member having an internal flange which is spaced from the skirt and is substantially parallel thereto, said internal flange having a third opening which coincides with said first opening in said skirt of said closure member, said internal flange and said skirt being arranged so that said wall of said body is received between said internal flange and said skirt and coupled thereto by said retaining strip in its folded condition, said folded retaining strip extending through both said first and second openings to be received in said third opening.

18. A coupling as claimed in claim 1 and further comprising an assembly of a first component and a second component, said first wall part being carried by said first component and said second wall part being carried by said second component with said second opening in said second wall part, and wherein said first and second components are coupled together by said retaining strip in its folded condition, said retaining strip extending through said first opening in the first wall part and said second opening in the second wall part.

19. A coupling as claimed in claim 1 in which said retaining strip engages with said track means to retain said retaining strip on the first wall part.

* * * * *